US009016228B2

(12) United States Patent
Dorton et al.

(10) Patent No.: US 9,016,228 B2
(45) Date of Patent: Apr. 28, 2015

(54) SWIM PLATFORM

(71) Applicant: Bryant Boats, Inc., Sweetwater, TN (US)

(72) Inventors: Benjamin Parker Dorton, Knoxville, TN (US); John R. Dorton, Knoxville, TN (US)

(73) Assignee: Bryant Boats, Inc., Sweetwater, TN (US)

( * ) Notice: Subject to any disclaimer, the term of this patent is extended or adjusted under 35 U.S.C. 154(b) by 90 days.

(21) Appl. No.: 13/836,696

(22) Filed: Mar. 15, 2013

(65) Prior Publication Data

US 2014/0261133 A1 Sep. 18, 2014

(51) Int. Cl.
*B63B 27/14* (2006.01)

(52) U.S. Cl.
CPC ..... *B63B 27/146* (2013.01)

(58) Field of Classification Search
CPC ..... B63B 17/00; B63B 27/14
USPC ..... 114/362, 343
See application file for complete search history.

(56) References Cited

U.S. PATENT DOCUMENTS

| | | | | | |
|---|---|---|---|---|---|
| 3,613,137 | A | | 10/1971 | Eccles | |
| 4,548,155 | A | | 10/1985 | Hegg et al. | |
| 4,669,414 | A | * | 6/1987 | Molino | 114/343 |
| 4,742,795 | A | * | 5/1988 | DePrey et al. | 114/362 |
| 5,094,640 | A | | 3/1992 | Burdick et al. | |
| 5,329,074 | A | | 7/1994 | Alexander | |
| 5,481,998 | A | * | 1/1996 | Trent | 114/355 |
| 5,572,944 | A | | 11/1996 | Slikkers et al. | |
| 5,632,224 | A | * | 5/1997 | Schneider | 114/362 |
| 5,645,912 | A | * | 7/1997 | Nelson et al. | 428/67 |
| 5,692,581 | A | * | 12/1997 | Nelson et al. | 182/129 |
| 7,121,226 | B2 | * | 10/2006 | Grimaldi | 114/362 |
| 7,162,969 | B2 | * | 1/2007 | Houlder et al. | 114/362 |
| 7,182,175 | B1 | * | 2/2007 | Schmitt et al. | 182/88 |
| 7,341,016 | B2 | * | 3/2008 | Terleski et al. | 114/343 |
| 7,370,598 | B1 | * | 5/2008 | Bootes | 114/362 |
| 7,946,243 | B1 | * | 5/2011 | Ulrich | 114/362 |
| 8,028,639 | B2 | | 10/2011 | Rodger | |
| 8,375,880 | B1 | * | 2/2013 | St. Clair et al. | 114/362 |
| 2007/0006789 | A1 | * | 1/2007 | Davidson et al. | 114/362 |
| 2011/0023770 | A1 | | 2/2011 | Brown | |
| 2013/0047909 | A1 | * | 2/2013 | Mueller | 114/362 |
| 2013/0047910 | A1 | * | 2/2013 | Mueller | 114/362 |
| 2013/0160695 | A1 | * | 6/2013 | Gratz et al. | 114/362 |

* cited by examiner

*Primary Examiner* — Lars A Olson
*Assistant Examiner* — Jovon Hayes
(74) *Attorney, Agent, or Firm* — Luedeka Neely Group, P.C.

(57) ABSTRACT

A swim platform for mounting onto the stern of a boat. Generally, the swim platform includes an upper platform, a lower platform, and a central support member for interconnecting the platforms and for mounting the swim platform to the boat. The platforms are sized and configured such that one or more persons could comfortably stand or sit on them. A forward portion of the lower platform is disposed proximate a rearward portion of the upper platform. Also, the lower platform is spaced vertically below the top platform and is ideally positioned at or slightly above the surface of the water. In operation, as the boat accelerates, the lower platform tilts towards the water as the bow tilts upwards. As the lower platform contacts the water, an upward force is exerted onto the lower platform, which forces the bow downwards and simultaneously forces the stern up and out of the water.

21 Claims, 16 Drawing Sheets

SWIM PLATFORM

FIELD

This invention relates to a swim platform for a boat. More particularly, this invention relates to a stern-mounted swim platform adapted to aid the boat in getting on plane.

BACKGROUND

Stern drive boats typically include a motor mounted inside the boat in front of the transom. A propulsion leg extends from the motor rearward and through the transom. The propulsive force in these types of boats is typically behind and below the rear most portion of the boat. In many stern drive boats, a swim platform and ladder is provided at the stern of the boat, either built into the boat or mounted on the boat. Swim platforms are particularly useful for sports such as wake boarding and water skiing. However, typically a swim platform is positioned too high above the water for optimum convenience, and while the platform may provide some separation between users and the propeller, it may be desirable to provide additional separation. Therefore, the present invention provides a more convenient swim platform with greater separation between the propeller and users.

SUMMARY OF THE CLAIMS

A cantilever swim platform is mounted onto the stern of a boat having a planing hull. The hull includes a bow and port and starboard sides extending between the bow and stern. Generally, the swim platform includes an upper platform, a lower platform, and central support member.

The upper platform includes a continuous generally U-shaped rear edge terminating at a first end and second end and a forward edge connecting the first end and second end. A first substantially planar top surface is defined by the forward edge and rear edge. Similarly, the lower platform includes a continuous generally U-shaped rear edge terminating at a first end and a second end and a forward edge connecting the first end and second end.

A second substantially planar top surface is defined by the forward edge and rear edge of the lower platform. A forward portion of the lower platform is disposed proximate a rearward portion of the upper platform. Also, the second top surface is spaced vertically below the first top surface and is ideally positioned slightly above the surface of the water when the boat is resting.

A ladder may mounted to the lower platform. The ladder may transition from a use position to a stowed position. The top surfaces may include non-slip surfaces. A guard may be fixedly mounted between the upper platform and the lower platform. The guard may include a plurality of horizontal bars intersecting a plurality of vertical bars.

A central support member connects together the upper platform and lower platform. It includes an upper prong extending from the central support member and a lower prong extending from the central support member. The upper prong and lower prong are spaced apart from one another. The upper prong is configured for mounting to the upper platform and the lower prong is configured for mounting to the lower platform. Mounting hardware is located on the central support member and is configured for mounting the central support member to the boat.

The swim platform may also include first and second side platforms. Each side platform includes a third substantially planar top surface. The first side platform is located adjacent a first side of the upper platform and the second side platform is located adjacent a second side of the upper platform. A first lower support leg connects the first side platform to the lower platform and a first upper support leg connects the first side platform to the upper platform. A second lower support leg connects the second side platform to the lower platform and a second upper support leg connects the second side platform to the upper platform.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1:
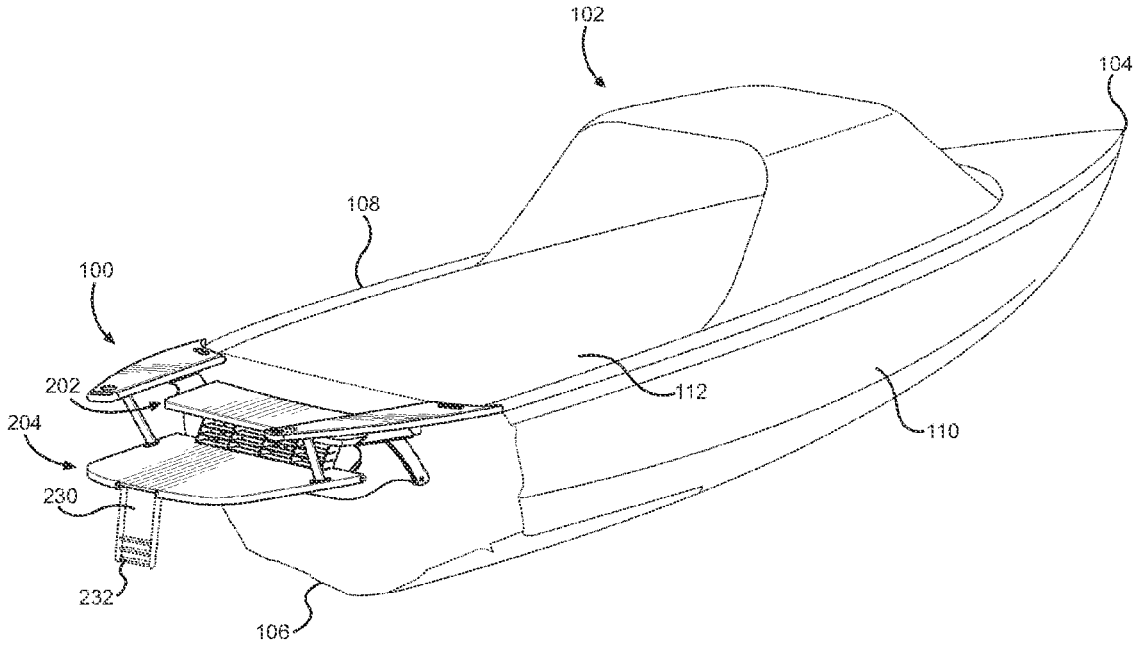
FIG. 1 is a rear perspective view of a boat having a swim platform according to the present disclosure mounted thereto.

Referring now to the drawings and FIG. 1 in particular, there is provided a swim platform 100 according to embodiments of the present disclosure secured to a hull 102. In general, the hull 102 comprises a bow 104, a stern 106, a port side 108 and a starboard side 110. A substantially planar deck area 112 covers at least a portion of the hull 102. As the boat accelerates through the water, the bow 104 will tend to rise up out of the water, which then causes the stern 106 to tilt towards the surface of the water. Unrestricted, this motion often obstructs the view of the person directing the boat and makes transitioning to planing mode slow and inefficient. However, as explained in greater detail below, with the swim platform 100 in place, the bow 104 is kept closer towards the surface of the water and the transition to planing mode is improved. Additionally, the swim platform 100 provides easy access onto and off of the boat and also offers some protection against inadvertently contacting a propeller located near the back of the boat.

Figure 2:
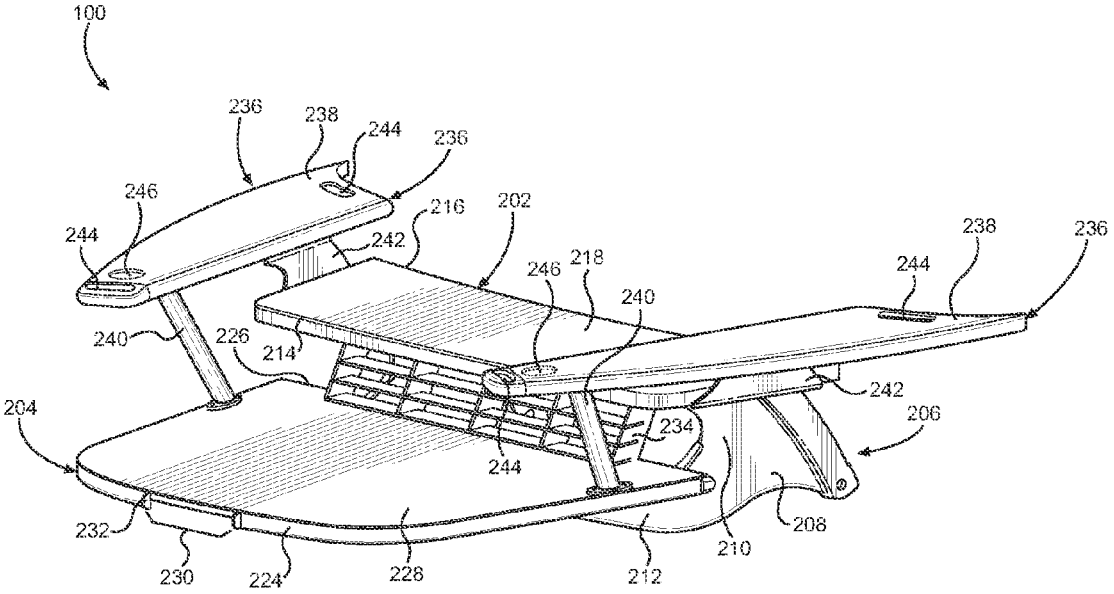
FIG. 2 is an enlarged perspective view of a swim platform.

As shown in FIG. 2, the swim platform 100 generally comprises an upper platform 202, a lower platform 204 and a central support member 208 for connecting together the upper platform 202 and lower platform 204 and for mounting the swim platform 100 to a mounting bracket 206 which is mounted to the boat or hull 102. The swim platform 100 may be constructed from any material including, but not limited to, aluminum, stainless steel, plastic or fiberglass.

Figure 16:
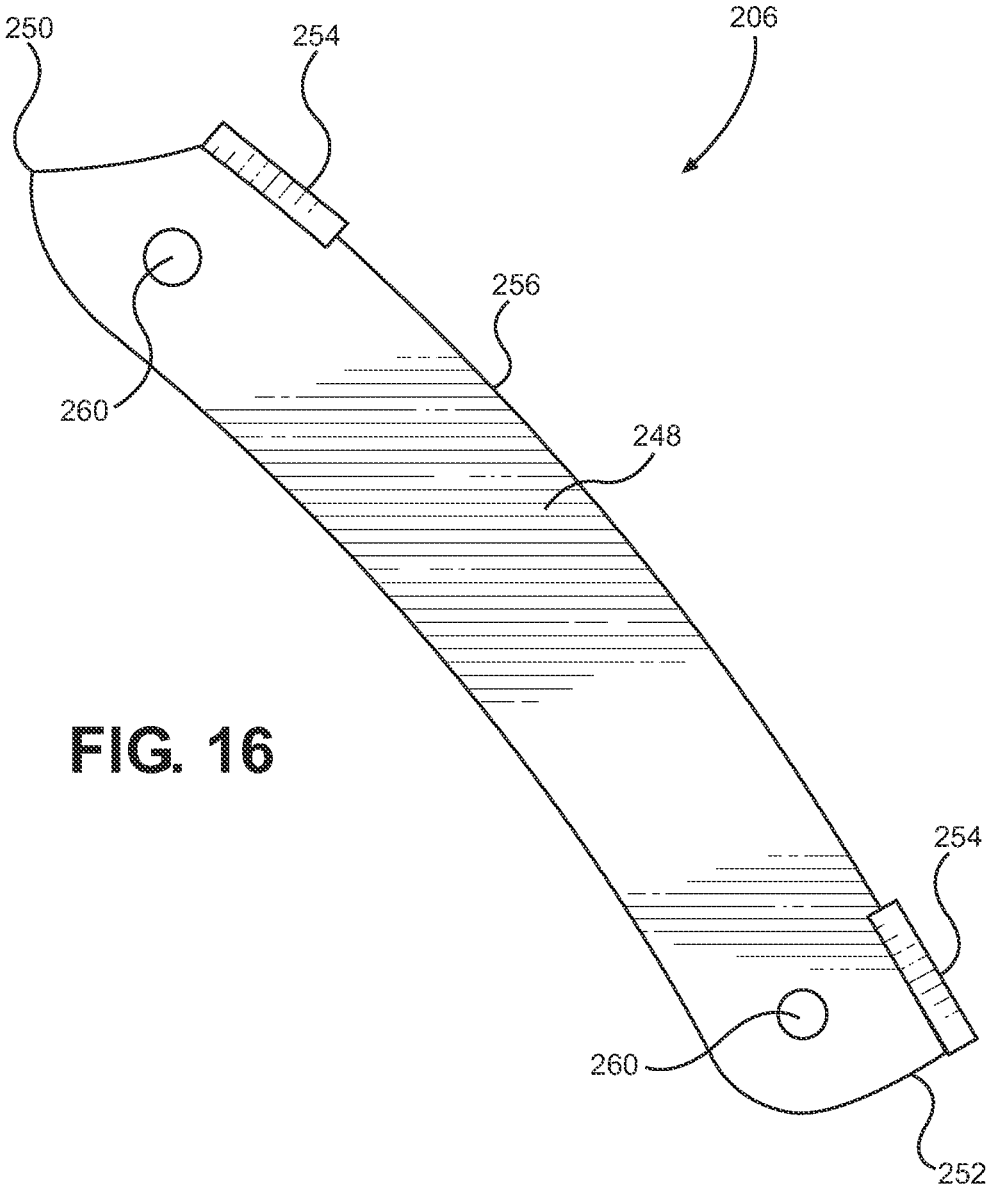
FIG. 16 is a side view of the mounting bracket.
Figure 17:
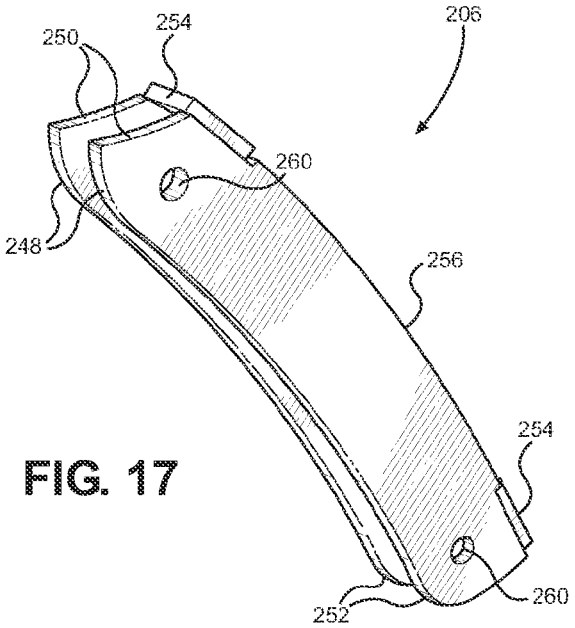
FIGS. 17 and 18 are perspective views of the mounting bracket.
Figure 18:
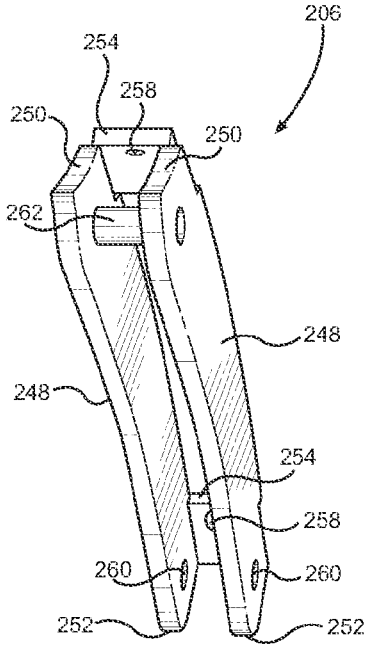

With reference to FIGS. 16-18, the mounting bracket 206 generally includes a pair of spaced apart elongate arm members 248 having an upper end 250 and a lower end 252. One mounting bracket 206 is connected to the port side 108 of the hull 102 and a second mounting bracket is connected to the starboard side 110 of the hull. Mounting plates 254 are fixedly connected to a forward edge 256 at each of the upper and lower ends 250, 252. Each of the mounting plates 254 include an aperture 258 through which a connector, such as a bolt, may be inserted in order to attach the mounting bracket 206 to the portion of a boat hull 102.

The mounting bracket 206 may further include connection apertures 260 in the upper end 250 and lower end 252 of each of the arm members 248. The connection apertures 260 are configured to receive a connector, such as a through bolt, to connect the mounting bracket 206 to the central support 208. In certain embodiments, as shown best in FIG. 18, a bar 262 may be inserted into the connection apertures to facilitate a hook-type connection between the mounting bracket 206 and the central support 208. This type of connection is explained in greater detail below.

With reference to FIG. 2, the upper platform 202 is defined by a rear edge 214 and a forward edge 216. A first substantially planar top surface 218 is defined by the forward edge 216 and the rear edge 214. The first top surface 218 is sized and configured to function as a seat or step for ingress and egress into or out of the boat. In particular, the first top surface 218 provides a flat surface that extends outwards away from the stern 106. The upper platform 202 is preferably sized such that one or more persons could comfortably stand or sit on the first top surface 218. To prevent a user from slipping, the first top surface 218 may be provided with a non-slip surface. The upper platform 202 may include means for securing persons, equipment or other items, such as straps, hooks, anchors, etc.

Figure 6:
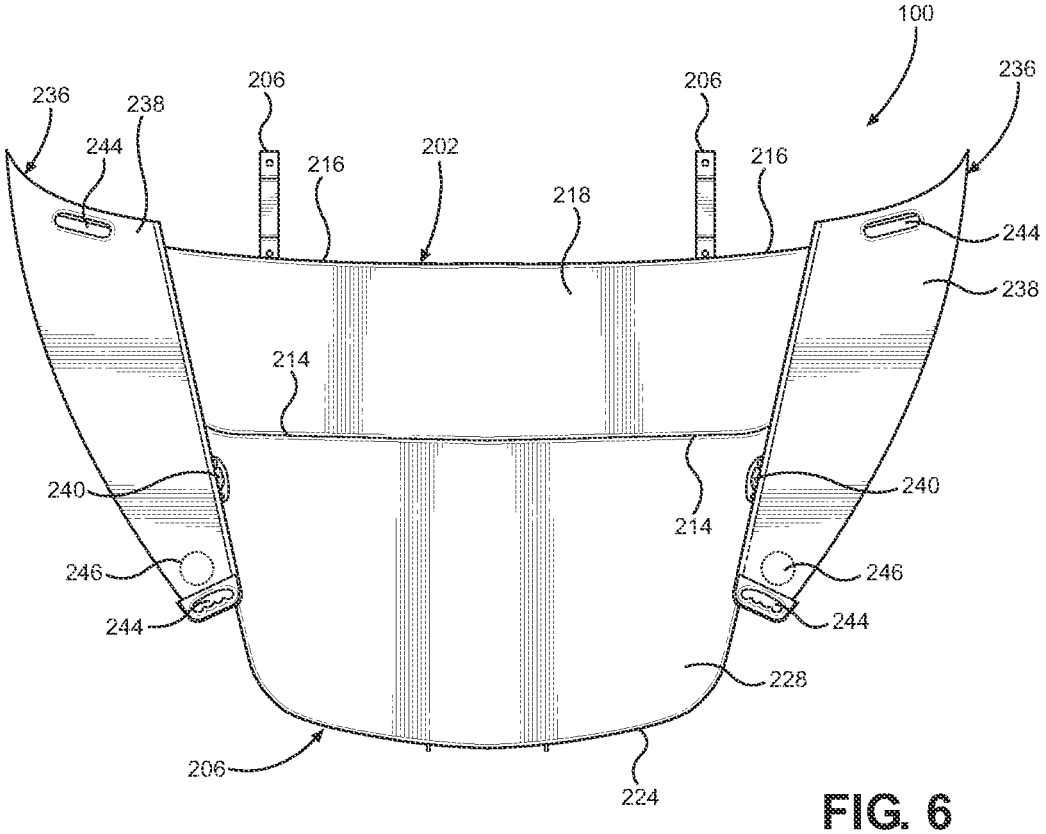
FIG. 6 is a top view of a swim platform.

Preferably, the rear edge 214 is continuous (i.e., unbroken or smooth) and is generally U-shaped so as to avoid sharp edges or corners. A continuous and smooth rear edge 214 is preferable to other configurations because it eliminates sharp corners and sides. Additionally, the forward edge 216 is preferably configured to closely conform to the shape and design of the stern 106 in order to minimize the gap between the swim platform 100 and the hull 102. For example, as shown in FIG. 6, the forward edge 216 may be curved to closely conform to a curved stern 106.

Figure 4:
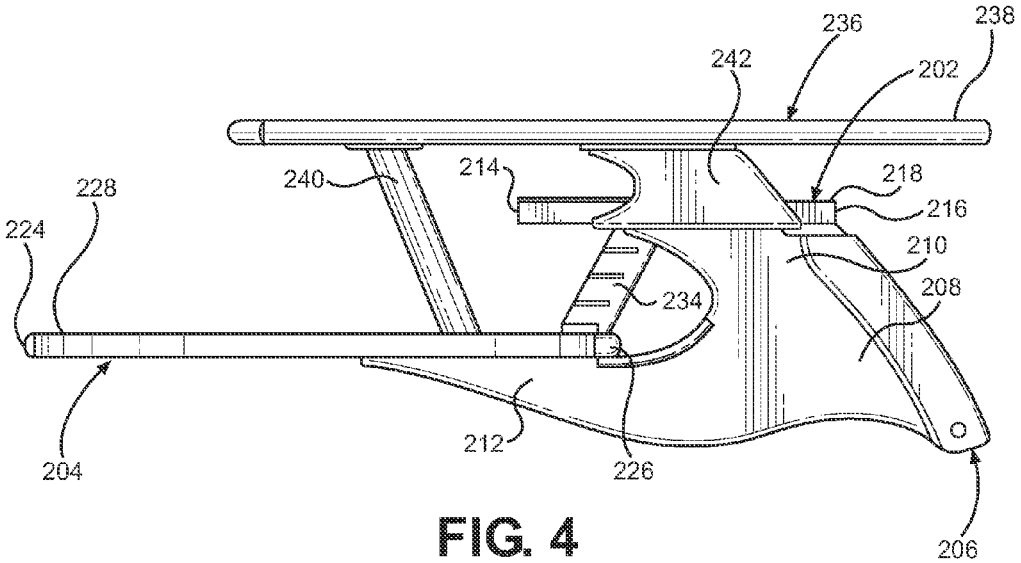
FIG. 4 is a right-side elevational view of a swim platform.
Figure 5:
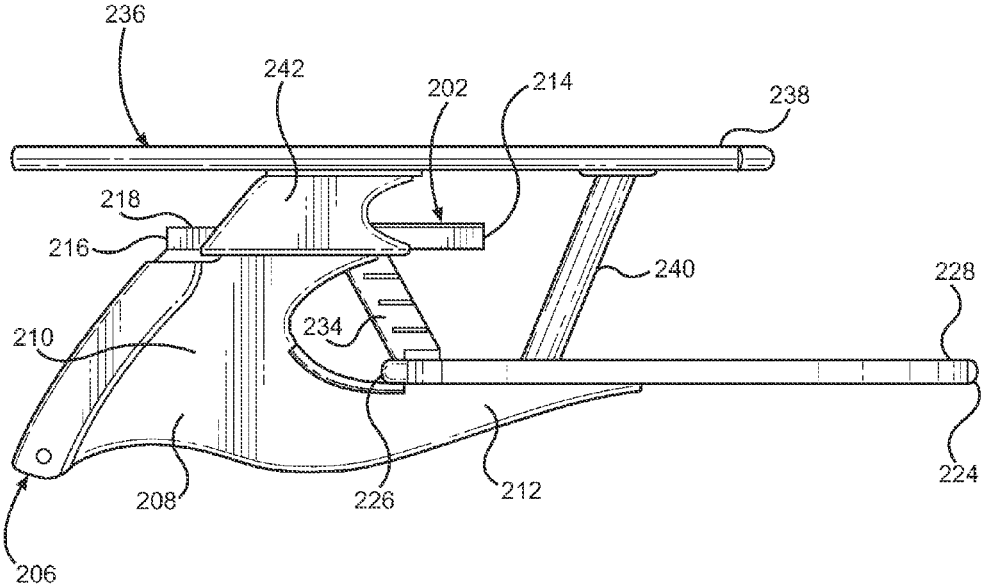
FIG. 5 is a right-side elevational view a swim platform.

The lower platform 204 is defined by a rear edge 224 and a forward edge 226. A second substantially planar top surface 228 is defined by the forward edge 226 and the rear edge 224. The second top surface 228 is sized and configured to function as a seat or step for ingress and egress into or out of the boat. In particular, the second top surface 228 provides a flat surface that extends outwards away from the stern 106 and from the first top surface 218. In particular, as shown in FIGS. 4 and 5, to minimize the gap between the upper platform 202 and the lower platform 204, the rear edge 214 of the upper platform 202 may overlap the forward edge 226 of the lower platform 204.

The lower platform 204 is preferably sized such that one or more persons could comfortably stand or sit on the second top surface 228. More preferably, the lower platform 204 is sized such that a user can comfortably stand on the platform along with other objects such as watersports equipment (skis, a wakeboard, etc.), beverage coolers, etc. To prevent a user from slipping, the fist top surface 218 may be provided with a non-slip surface. The lower platform 204 may include means for securing persons, equipment or other items, such as straps, hooks, anchors, etc.

Figure 7:
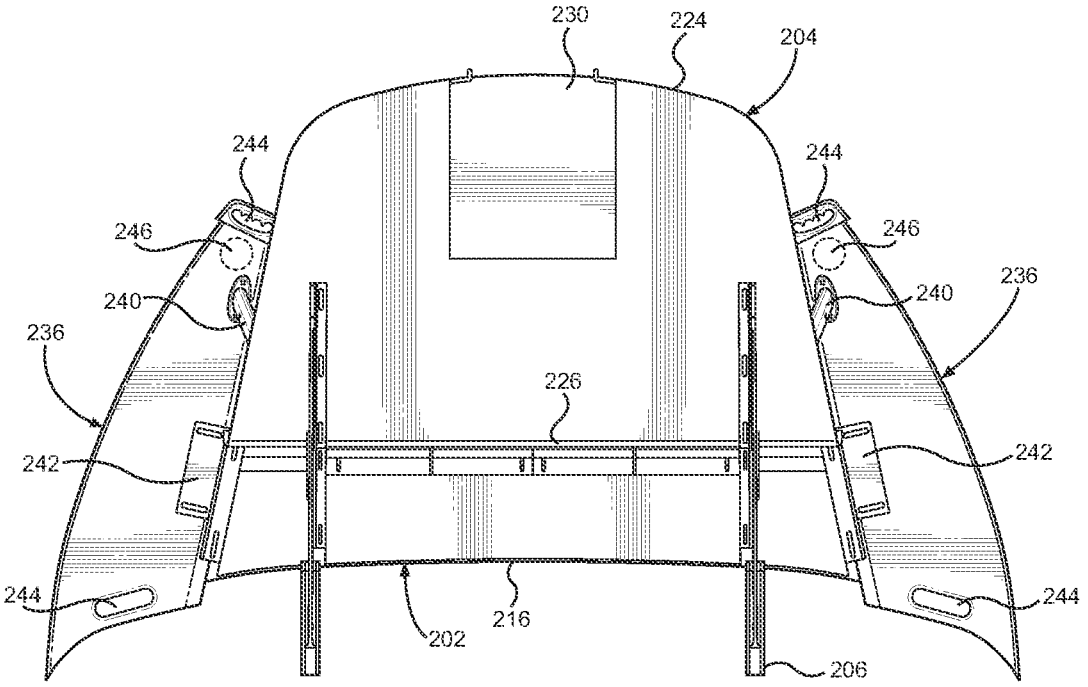
FIG. 7 is a bottom view of a swim platform.
Figure 8:
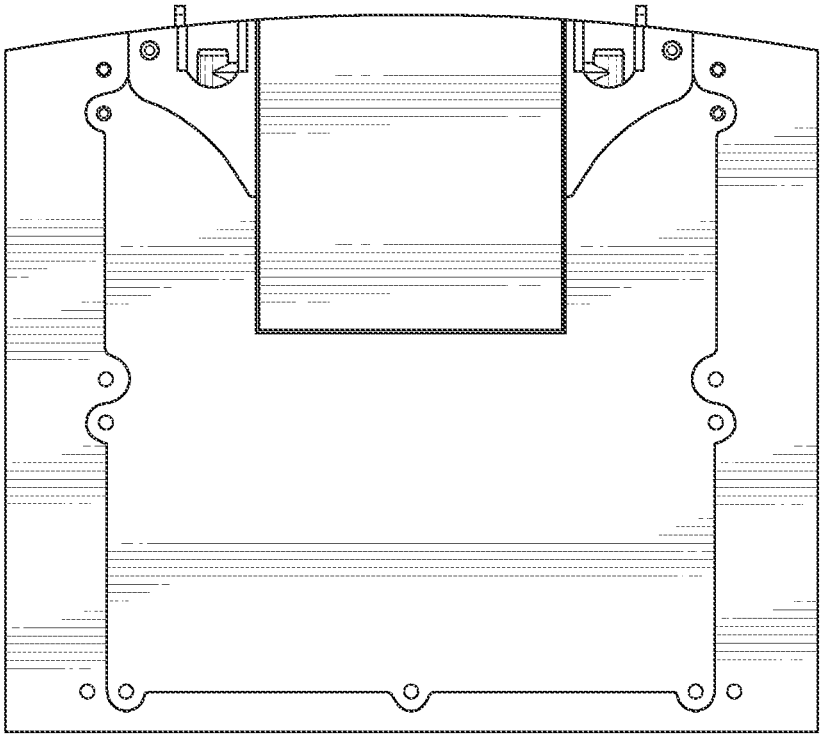
FIG. 8 is a bottom view of a lower platform of a swim platform where the ladder is substantially obscured in the stowed position.
Figure 9:
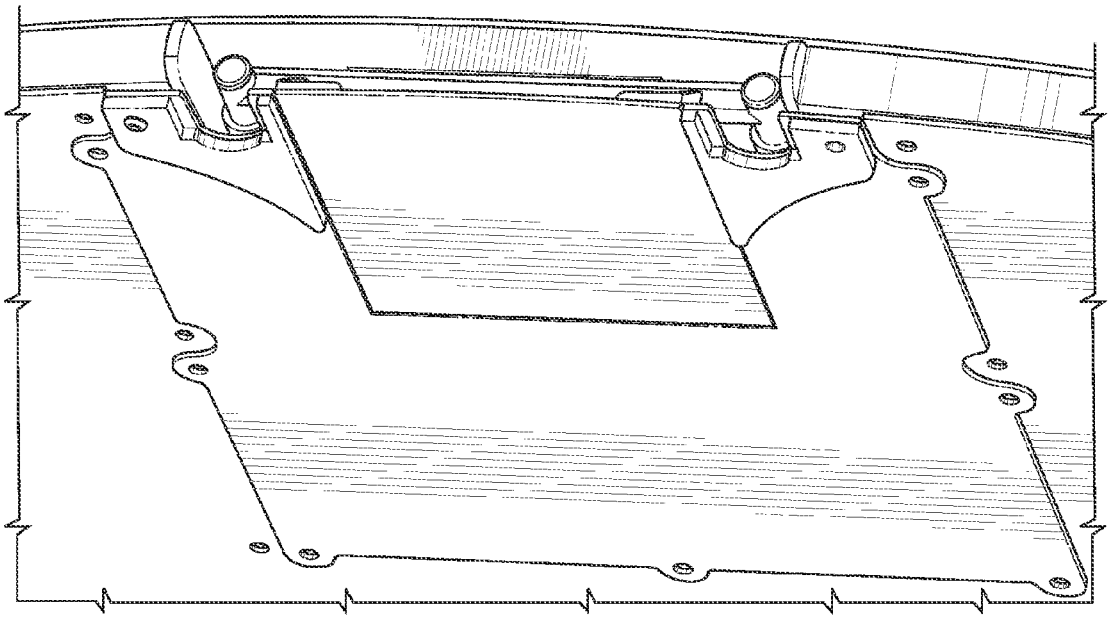
FIG. 9 is a lower perspective view of a lower platform of a swim platform showing a ladder in the stowed position.
Figure 10:
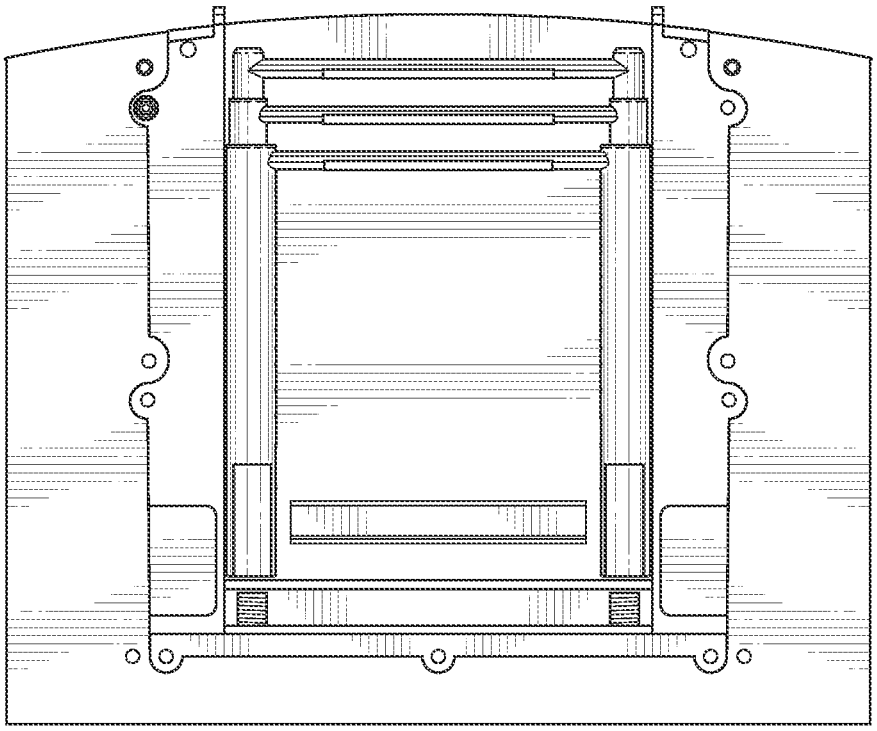
FIG. 10 is a bottom view of a lower platform of a swim platform showing an exposed ladder.

Preferably, the rear edge 224 is continuous (i.e., unbroken or smooth) and is generally U-shaped so as to avoid sharp edges or corners. As shown in FIGS. 1, 2 and 7, the rear edge 224 may include a ladder cutout 230 into which a ladder 232 may be inserted. The ladder 232 is preferably configured to transition from a use position to a stowed position. A locking device may be provided to secure the ladder 232 in the stowed position. In the use position, as shown in FIG. 1, the ladder 232 (shown in phantom) extends downwards away from the lower platform 204. When not in use, such as when the boat is in motion, the ladder 232, may be inserted into the ladder cutout 230.

The swim platform 100 may further comprise a guard 234 that is designed to prevent users or objects from inadvertently slipping between the upper platform 202 and the lower platform 204. Preferably, the guard 234 is fixedly mounted between the upper platform 202 and the lower platform 204. However, it is also contemplated that the guard 234 may be removably attached to the swim platform 100. The guard 234 may comprise a plurality of horizontal bars intersecting a plurality of vertical bars.

Figure 11:
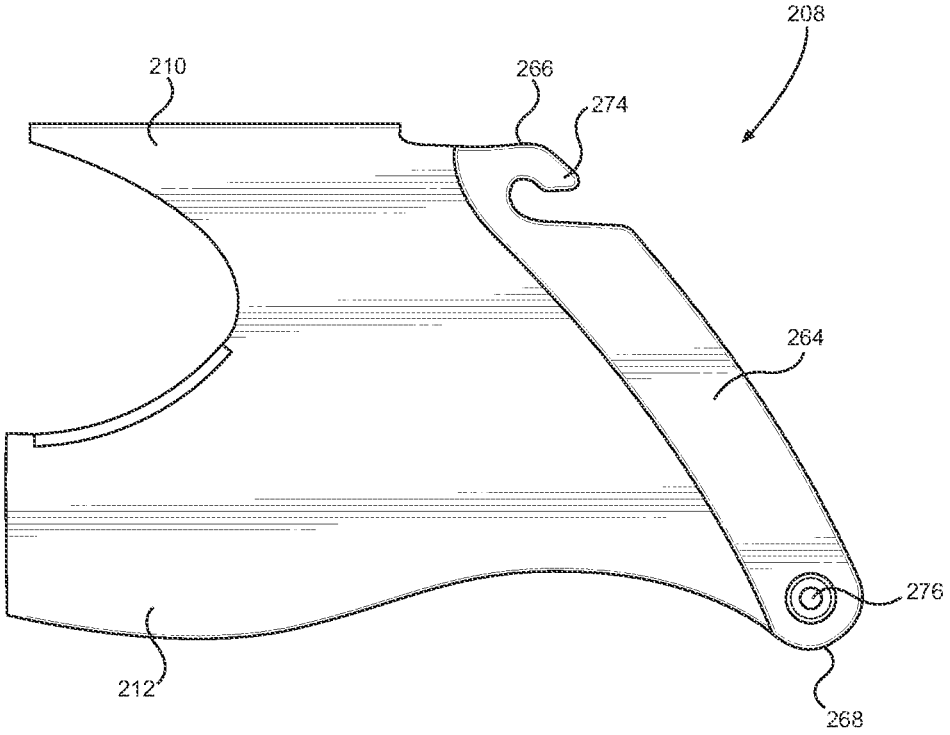
FIG. 11 is a side view of the central support member.
Figure 12:
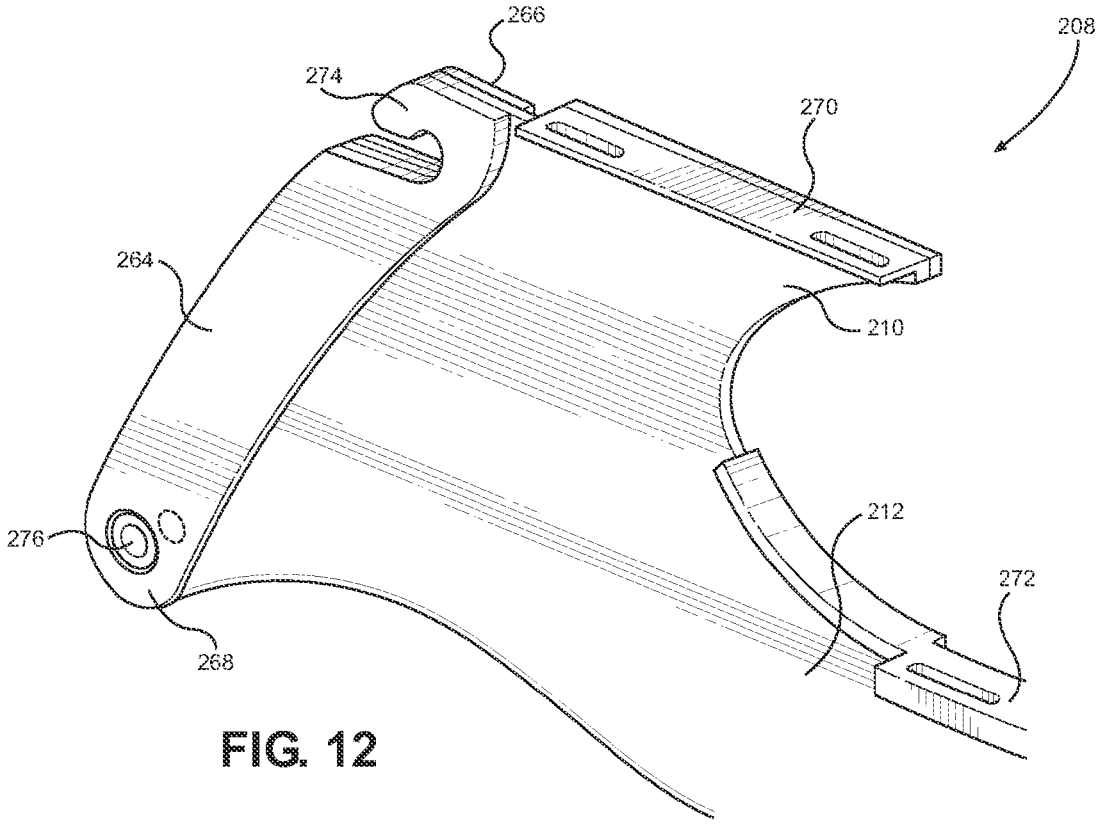
FIGS. 12 and 13 are an upper perspective views of the central support member.
Figure 13:
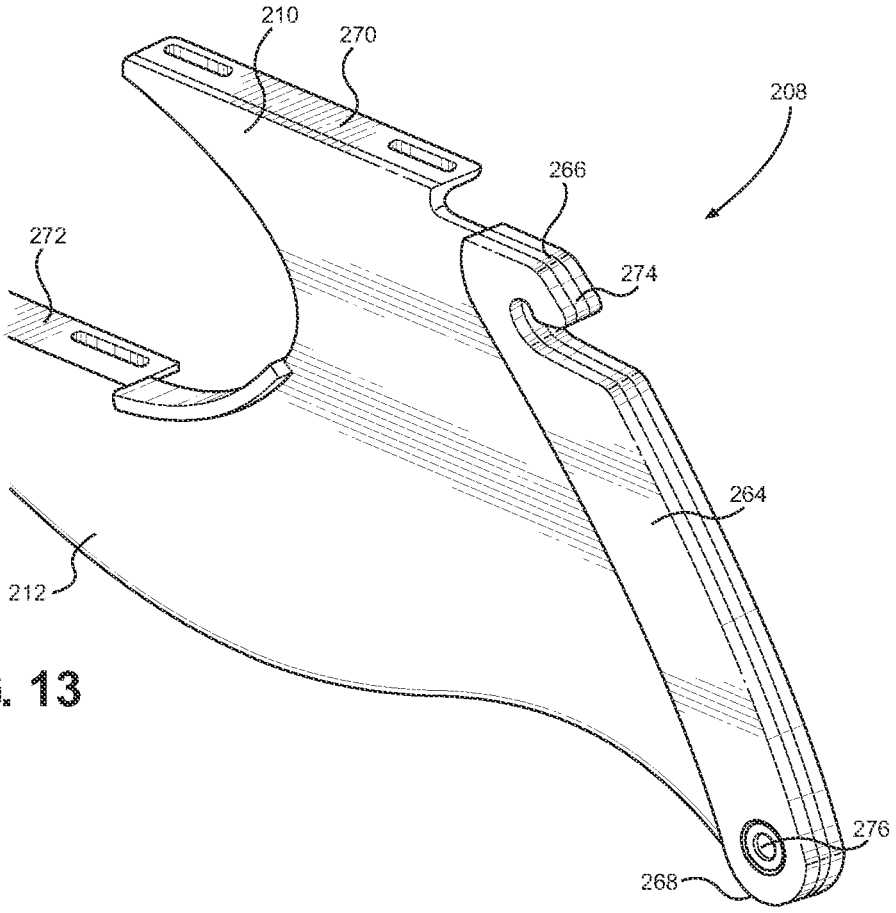

As shown in FIG. 1, the central support 208 is mounted to the mounting bracket 206, which is located immediately adjacent the stern 106. As best shown in FIGS. 11-13, the central support 208 includes a pair of spaced apart elongate connection members 264, one member mounted to either side of the swim platform 100. The connection members 264 each have an upper end 266 and a lower end 268 and further include an upper prong 210 disposed adjacent the upper end 266 and a lower prong 212 disposed at the lower end 268. Each of the prongs 210, 212 is connected to and extends rearward away from the connection member 264. As shown in FIGS. 12 and 13, the upper prong 210 includes an upper mounting surface 270 for mounting the upper platform 202 to the central support 208. Similarly, the lower prong 212 includes a lower mounting surface 272 for mounting the lower platform 204 to the central support 208.

Figure 3:
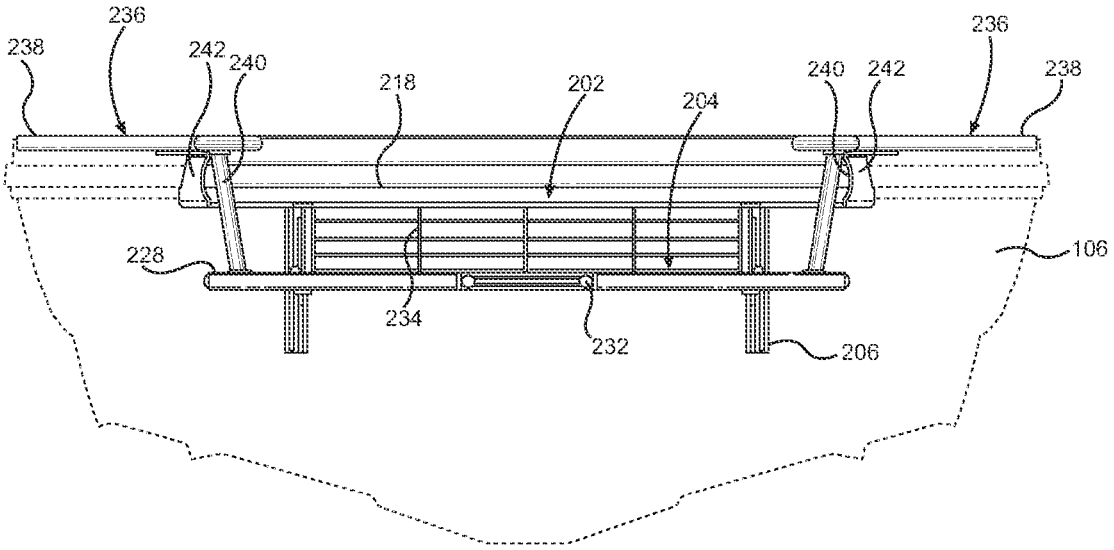
FIG. 3 is a front elevational view of a boat having a swim platform mounted thereto.

The upper prong 210 is configured to mount to and secure the upper platform 202. As shown in FIG. 2, the upper prong 210 may mount to a bottom portion of the upper platform 202. As shown in FIG. 3, once the swim platform 100 is mounted to the stern 106, the upper platform 202 is preferably positioned slightly below the top of the stern 106. Ideally, the upper platform is positioned about 6-12 inches below the top of the stern 106.

Similarly, the lower prong 212 is configured to mount to and secure the lower platform 204. The lower prong 212 may mount to a bottom portion of the lower platform 204. As shown in FIG. 3, once the swim platform 100 is mounted to the stern 106, the lower platform 204 is preferably positioned slightly below the level of the upper platform 202. Ideally, the lower platform 204 is positioned about 6-12 inches below the upper platform 202, and is configured such that the lower platform is at or slightly above the water level when the hull 102 is substantially level (i.e., when the boat is resting and the bow is not tilted upwards away from the water). For example, when the boat is resting, the lower platform 204 may be positioned 1-3 inches above the water. Of course, the exact position of the lower platform 204 will change with the different loads in the boat.

Positioning the upper platform 202 and lower platform 204 in this manner creates a stair-like configuration, which provides easy access on and off of the boat. Another benefit of this configuration is that it provides some protection for occupants against contacting a propeller that is located behind the boat.

Finally, the lower platform 204 acts as a trim tab or leveling device for the boat. When a boat accelerates, the bow 104 often begins to rise out of the water and the stern 106 will be pushed lower into the water. With the swim platform 100 mounted to the boat, the lower platform 204 will be lowered towards the water as the bow 104 begins to tilt upwards. As the lower platform 204 makes contact with the water, an upward force is exerted onto the lower platform, which causes the bow 104 to move downwards and simultaneously moving the stern 106 up and out of the water. As a result, the boat reaches planing mode more quickly and with less power than a boat having no such platform.

As shown throughout the drawings and as best shown in FIG. 2, the swim platform 100 may further comprise a side platform 236 having a third substantially planar top surface 238. The side platform 236 may be disposed on either side of the swim platform 100. Preferably, the side platform 236 is spaced vertically above the first top surface 218 of the upper platform 202. The side platform 236 is preferably connected to both the upper platform 202 and the lower platform 204. In particular, a lower support leg 240 connects the side platform 236 to the lower platform 204 and an upper support leg 242 connects the side platform 236 to the upper platform 202. However, it is contemplated that the side platform 236 may be connected to only to upper platform 202 or the lower platform 204. The side platform 236 and the support legs 240, 242 are preferably fixedly attached to the swim platform 100. However, the side platform 236 and the support legs 240, 242 may be removably attached to the swim platform 100. The swim platform 100 may comprise two side platforms 236, wherein one side platform 236 is disposed on either side of the swim platform 100. The side platforms 236 may comprise one or more handles 244. Additionally, the side platforms 236 may further comprise one or more cup holders 246.

With reference to FIGS. 11-13, each connection member 264 includes a cutout portion located at the upper end 266, wherein the cutout portion forms a hook 274. Additionally, a second cutout portion located at the lower end 268 forms a pivot attachment 276.

Figure 14:
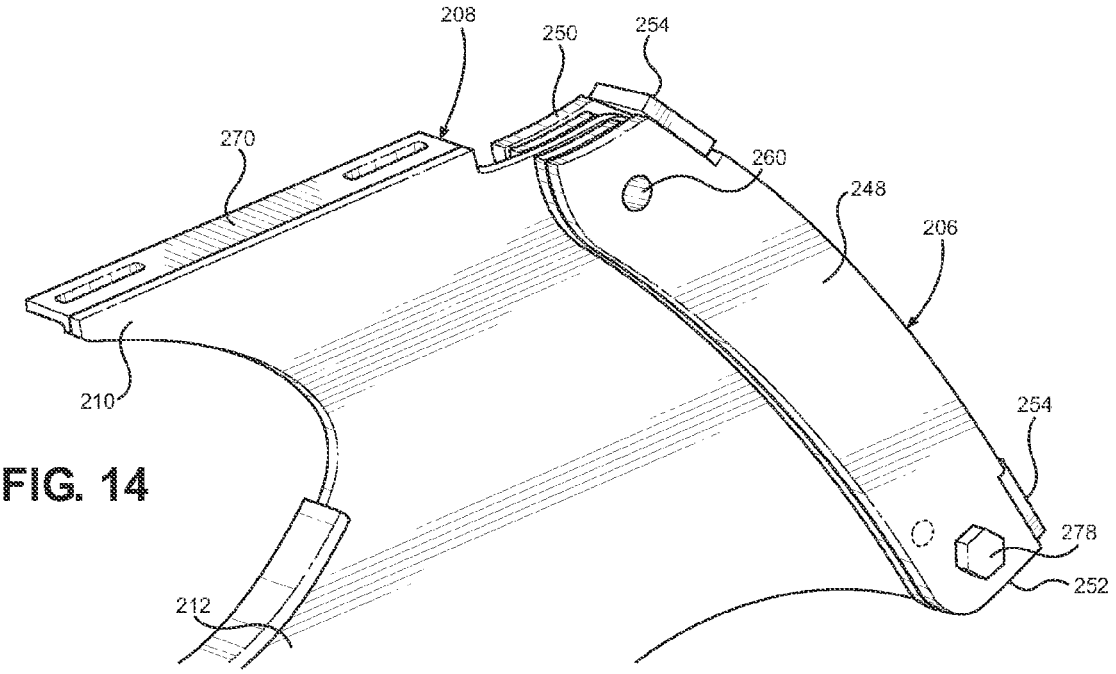
FIG. 14 is an upper perspective view of the central support connected to the mounting bracket including a mounting pin.
Figure 15:
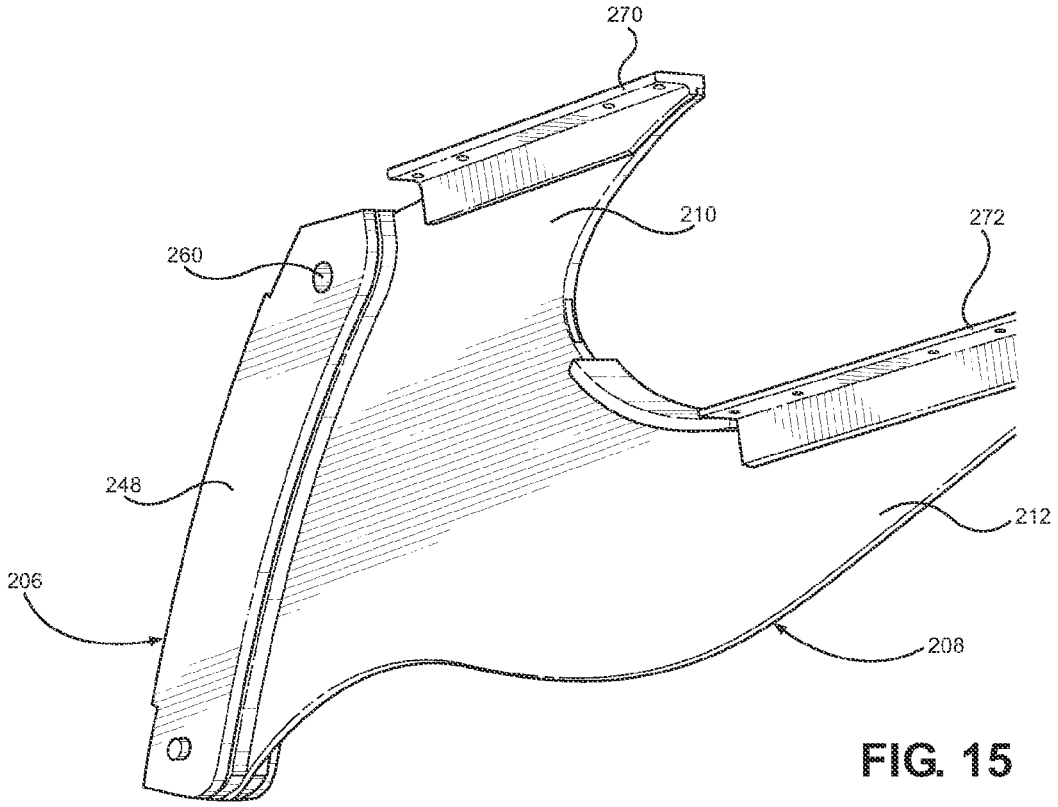
FIG. 15 is an lower perspective view of the central support connected to the mounting bracket including a mounting pin.

The central support 208 may be connected to the mounting bracket 206 by first attaching the hook 274 to the bar 262 (FIG. 18). The central support 208 is then pivoted around the bar 262 of the mounting bracket 206 such that the connection member 264 is seated within the space between the spaced apart elongate arm members 248. The pivot attachment 276 of the central support 208 and the connection apertures 260 at the lower end 268 of the central support 208 are aligned. Finally, as shown in FIGS. 14 and 15, a bolt 278 is inserted through the connection apertures 260 and pivot attachment 276, to fixedly connect the central support 276 and mounting bracket 206 together.

The swim platform 100 is attached to the stern 106 of the boat using a plurality of fasteners. In certain embodiments, through bolts may be inserted through each of the side platforms 236 and into a portion of the hull 102. Additionally or alternatively, through bolts may also be inserted through the central support member 208 and then into the hull 102. The hull 102 may further comprise brackets mounted to the hull for receiving the bolts and that correspond to each of the through bolts. However, one skilled in the art will appreciate that other fastening means may be used in other embodiments, and that the invention is not limited by the type of fastener used to connect the swim platform 100 to the hull 102.

The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A cantilever swim platform adapted to be mounted onto the stern of a boat having a planing hull for use in a body of water and further including a bow and port and starboard sides extending between the bow and stern, the swim platform comprising:

an upper platform comprising a first substantially planar top surface;

a lower platform rigidly connected to the upper platform such that the lower platform is in a fixed position relative to the upper platform and such that the lower platform is positioned above a top surface of the body of water, the lower platform comprising a second substantially planar top surface a forward portion of the lower platform being disposed proximate a rearward portion of the upper platform and the second top surface spaced vertically below the first top surface; and a central support member disposed on each of the port and starboard sides of the boat for connecting together the upper platform and lower platform, the central support member comprising:

an upper prong configured for mounting to the upper platform, a lower prong configured for mounting to the lower platform, and mounting hardware for mounting the central support member to the boat, wherein the upper prong extends from the mounting hardware to the upper platform and the lower prong extends from the mounting hardware to the lower platform for connecting the upper and lower platforms directly to the boat.

2. The swim platform of claim 1 further comprising a side platform comprising a third substantially planar top surface, the side platform disposed adjacent a side of the upper platform and the top surface spaced vertically above the first top surface, wherein a lower support leg connects the side platform to the lower platform and an upper support leg connects the side platform to the upper platform.

3. The swim platform of claim 2 wherein the lower platform is positioned adjacent the water when the boat is resting so that when the boat accelerates, the lower platform is forced downwardly by the stern into the water whereby the lower platform creates an upward force on the stern and facilitates planing of the boat.

4. The swim platform of claim 2 further comprising a second side platform disposed adjacent a second side of the upper platform.

5. The swim platform of claim 1 further comprising a guard fixedly mounted between the upper platform and the lower platform, the guard comprising a plurality of long horizontal bars intersecting a plurality of short vertical bars.

6. The swim platform of claim 1 further comprising a ladder mounted to the lower platform.

7. The swim platform of claim 6 wherein the ladder is operable to transition between a stowed position and a use position.

8. The swim platform of claim 1 wherein at least one of the upper platform and lower platform comprise a non-slip surface.

9. The swim platform of claim 1 wherein the mounting hardware comprises at least one hook.

10. A cantilever swim platform adapted to be mounted onto the stern of a boat having a planing hull and further including a bow and port and starboard sides extending between the bow and stern, the swim platform comprising:

an upper platform comprising a continuous generally U-shaped rear edge terminating at a first end and second end, a forward edge connecting the first end and second end, and a first substantially planar top surface defined by the forward edge and rear edge;

a lower platform comprising a continuous generally U-shaped rear edge terminating at a first end and a second end, a forward edge connecting the first end and second end, and a second substantially planar top surface, a forward portion of the lower platform being disposed proximate a rearward portion of the upper platform and the second top surface spaced vertically below the first top surface;

a central support member disposed on each of the port and starboard sides of the boat for connecting together the upper platform and lower platform, the central support member comprising:

an upper prong configured for mounting to the upper platform, a lower prong configured for mounting to the lower platform, and mounting hardware for mounting the central support member to the boat; and a first and second side platform, each side platform comprising a third substantially planar top surface, the first side platform disposed on the port side and the second side platform disposed on the starboard side, wherein a first lower support leg connects the first side platform to the lower platform and a first upper support leg connects the first side platform to the upper platform and wherein a second lower support leg connects the second side platform to the lower platform and a second upper support leg connects the second side platform to the upper platform.

11. The swim platform of claim 10 wherein the lower platform is positioned adjacent to and above the water when the boat is at rest and is positioned to engage the water when the boat is accelerating to raise the stern of the boat to thereby assist the boat to get on plane.

12. The swim platform of claim 10 further comprising a ladder mounted to the lower platform.

13. The swim platform of claim 12 wherein the ladder operable to transition between a stowed position and a use position.

14. The swim platform of claim 10 wherein at least one of the upper platform and lower platform comprise a non-slip surface.

15. The swim platform of claim 10 further comprising a guard fixedly mounted between the upper platform and the lower platform, the guard comprising a plurality of horizontal bars intersecting a plurality of vertical bars.

16. A watercraft comprising:

a planing boat hull comprising a stern, a bow, starboard and port sides, and a substantially planar deck area covering at least a portion of the hull, the deck area disposed between the starboard and port sides and extending forward from the stern towards the bow;

a cantilever swim platform adapted to be mounted onto the stern of a boat, the swim platform comprising:

an upper platform comprising a continuous generally U-shaped rear edge terminating at a first end and second end, a forward edge connecting the first end and second end, and a first substantially planar top surface defined by the forward edge and rear edge;

a lower platform comprising a continuous generally U-shaped rear edge terminating at a first end and a second end, a forward edge connecting the first end and second end, and a second substantially planar top surface, a forward portion of the lower platform being disposed proximate a rearward portion of the upper platform and the second top surface spaced vertically below the first top surface; and a central support member disposed on each of the port and starboard sides of the boat for connecting together the upper platform and lower platform, the central support member comprising:

an upper prong configured for mounting to the upper platform, a lower prong configured for mounting to the lower platform, and mounting hardware for mounting the central support member to the boat; and a first and second side platform, each side platform comprising a third substantially planar top surface, the first side platform disposed on the port side and the second side platform disposed on the starboard side, wherein a first lower support leg connects the first side platform to the lower platform and a first upper support leg connects the first side platform to the upper platform and wherein a second lower support leg connects the second side platform to the lower platform and a second upper support leg connects the second side platform to the upper platform.

17. The swim platform of claim 16 wherein the first side platform or the second side platform comprises at least one of a cup holder or a handhold.

18. The swim platform of claim 16 further comprising a guard fixedly mounted between the upper platform and the lower platform, the guard comprising a plurality of horizontal bars intersecting a plurality of vertical bars.

19. The swim platform of claim 16 further comprising a ladder mounted to the lower platform, wherein the ladder operable to transition between a stowed position and a use position.

20. The swim platform of claim 16 wherein at least one of the upper platform and lower platform comprise a non-slip surface.

21. A cantilever swim platform adapted to be mounted onto the stern of a boat having a planing hull and further including a bow and port and starboard sides extending between the bow and stern, the swim platform comprising:

an upper platform comprising a first substantially planar top surface;

a lower platform comprising a second substantially planar top surface;

an elongate central support member for connecting together the upper platform and lower platform, the central support member comprising an upper end, a lower end, a hook formed at the upper end and a pivot attachment formed at the lower end, wherein the upper platform is connected to the upper end and the lower platform is connected to the lower end;

a mounting bracket for pivotally attaching to the central support member, the mounting comprising:

spaced apart elongate arm members, each having an upper end and a lower end;

mounting plates fixedly connected to a forward edge at each of the upper and lower ends, wherein each of the mounting plates includes an aperture;

connection apertures formed in the lower end of each of the arm members; and a bar disposed between the upper end of the arm members, wherein the bar is configured to receive the hook and to provide a pivotal connection between the mounting bracket and the central support member such that the connection apertures and the pivot attachment may be aligned; and a connector configured for insertion into the connection apertures of the mounting bracket and the pivot attachment of the central support member to form a fixed connection between the mounting bracket and the central support member.

* * * * *